US010835048B2

(12) United States Patent
Choi

(10) Patent No.: US 10,835,048 B2
(45) Date of Patent: Nov. 17, 2020

(54) CONNECTION MEMBER AND FOLDING BED HAVING SAME

(71) Applicant: Inno-Sports Co., Ltd., Xiamen (CN)

(72) Inventor: Kwan Jun Choi, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 454 days.

(21) Appl. No.: 15/692,997

(22) Filed: Aug. 31, 2017

(65) Prior Publication Data

US 2018/0055236 A1 Mar. 1, 2018

(30) Foreign Application Priority Data

Aug. 31, 2016 (CN) ..... 2016 2 1004341 U
Oct. 20, 2016 (CN) ..... 2016 2 1141156 U

(51) Int. Cl.
*A47C 19/02* (2006.01)
*A47C 19/12* (2006.01)

(52) U.S. Cl.
CPC ..... *A47C 19/028* (2013.01); *A47C 19/022* (2013.01); *A47C 19/122* (2013.01)

(58) Field of Classification Search
CPC .... A47C 19/028; A47C 19/022; A47C 19/122
See application file for complete search history.

(56) References Cited

U.S. PATENT DOCUMENTS 1,934,396 A * 11/1933 Bales ..... A47C 1/124 297/58
2,106,724 A * 2/1938 Cope ..... H01R 4/14 439/783
2,821,762 A * 2/1958 Foose ..... A47C 1/124 24/459
3,188,138 A * 6/1965 Lockshin ..... A47C 1/124 297/248
3,636,595 A 1/1972 Wines
3,669,491 A * 6/1972 Weslock ..... A47C 1/124 297/248
4,066,373 A * 1/1978 Workman ..... A47C 1/124 24/339
4,224,721 A * 9/1980 Ohlson ..... F16B 7/0433 24/376
5,056,198 A 10/1991 Viglione
5,181,297 A 1/1993 Andrews, Jr.
5,211,459 A 5/1993 Wu
5,331,725 A * 7/1994 Chou ..... E04H 17/18 24/339
5,462,350 A 10/1995 Brightman
(Continued)

*Primary Examiner* — Robert G Santos
*Assistant Examiner* — Rahib T Zaman
(74) *Attorney, Agent, or Firm* — Morgan, Lewis & Bockius LLP

(57) ABSTRACT

A folding bed includes first and second bedsteads and one or more connection members coupling the first and second bedsteads. A connection member can be a frame or a leg connection member. A frame connection member includes first and second vertical end portions to removably couple adjacent peripheral bars of the first and second bedsteads. A leg connection member includes first and second engaging members to removably couple adjacent legs of the first and second bedsteads. The one or more connection members reduce the risk of bending the folding bed and assist in stabilizing the folding bed when in use.

21 Claims, 11 Drawing Sheets

(56) References Cited

U.S. PATENT DOCUMENTS

| | | | | |
|---|---|---|---|---|
| 5,706,626 | A | 1/1998 | Mueller | |
| 6,405,414 | B1 | 6/2002 | Byrnes | |
| 6,564,401 | B1 * | 5/2003 | Weinman | A47C 19/022 5/132 |
| 6,643,900 | B2 | 11/2003 | Jahrling | |
| D581,255 | S | 11/2008 | Calvin | |
| 8,398,034 | B2 | 3/2013 | Lambert | |
| 8,733,293 | B2 * | 5/2014 | Link | A01K 1/0017 119/474 |
| 9,314,386 | B1 * | 4/2016 | Boyd | A61G 7/015 |
| 10,021,986 | B1 * | 7/2018 | Lin | A47C 7/58 |
| 2004/0003462 | A1 * | 1/2004 | Tolleson | A47B 83/00 5/2.1 |
| 2004/0187623 | A1 | 9/2004 | Seuferling | |
| 2010/0176634 | A1 * | 7/2010 | Wahl | A47C 13/005 297/248 |
| 2012/0222216 | A1 * | 9/2012 | Jin | A47C 19/028 5/400 |
| 2013/0302085 | A1 * | 11/2013 | King | A47B 87/002 403/188 |
| 2013/0312185 | A1 * | 11/2013 | Suh | A47C 20/043 5/618 |
| 2017/0122353 | A1 * | 5/2017 | Halliburton | G01F 23/284 |

* cited by examiner

CONNECTION MEMBER AND FOLDING BED HAVING SAME

CROSS-REFERENCE TO RELATED APPLICATION

The present application claims priority to Chinese Patent Application No. 201621004341.7 filed on Aug. 31, 2016, and Chinese Patent Application No. 201621141156.2 filed on Oct. 20, 2016, the entire contents of which applications are incorporated herein for all purposes by this reference.

FIELD OF THE INVENTION

The present invention generally relates to folding beds. More particularly, the present invention relates to connection members and folding beds having such connection members.

BACKGROUND

As the population continues to expand and living quarters become more compact, articles of daily use must have diversified adjustable functions. An example of such articles of daily use is folding beds, which have become necessities for many homes as they can be manipulated in various ways to suit the available storage space and other needs of a user. Typically, folding beds are used in homes; but they can also be used outdoors for activities including camping and field projects. The service life of a folding bed can be attributed to the build quality and shake resistance.

Conventional folding beds are designed utilizing simple joints. To assemble a folding bed, a user usually needs to couple two bedsteads together with bolts, and rest a mattress thereon. However, such a coupling is often time-consuming and labor intensive. Further, when the folding bed is lifted up, the bolts connecting the two bedsteads can be easily bended, resulting in the overall structural of the folding bed unstable.

Given the current state of the art, there remains a need for connection members and folding beds that address the abovementioned issues.

The information disclosed in this Background section is provided for an understanding of the general background of the invention and is not an acknowledgement or suggestion that this information forms part of the prior art already known to a person skilled in the art.

SUMMARY

The present invention provides connection members to couple bedsteads and folding beds that are easier to setup and safer to use.

In various aspects, the present invention provides a folding bed including a first bedstead, a second bedstead, and one or more connection members to couple the first bedstead with the second bedstead. When the folding bed is in an unfolded state, the first bedstead is disposed on a first side and the second bedstead is disposed on a second side of the folding bed. A connection member in the one or more connection members can be either frame connection member or leg connection member. A folding bed can include only frame connection member(s), only leg connection member(s), or both of the frame and leg connection members.

In some embodiments, each of the first bedstead and the second bedstead includes a frame, a plurality of crossbars and a plurality of legs. The frame defines an interior, and the plurality of crossbars is disposed in a common direction in the interior defined by the frame and coupled to the frame. The plurality of legs is coupled with the frame or one or more of the crossbars, and includes a first leg. When the folding bed is in the unfolded state, the first leg of the first bedstead is disposed adjacent and substantially parallel to the first leg of the second bedstead. The one or more connection members includes a first leg connection member to couple the first leg of the first bedstead with the first leg of the second bedstead. The first leg connection member includes a first engaging member configured to removeably couple with the first leg of the first bedstead, a second engaging member configured to removeably couple with the first leg of the second bedstead, and a first link member connecting the first and second engaging members. The first engaging member, the first link member and the second engaging member are integrally formed in one unit. When engaged, the first leg connection member restricts a relative movement of the first leg of the first bedstead and the first leg of the second bedstead with respect to each other.

In an embodiment, the first and second engaging members of the first leg connection member are substantially the same and disposed substantially symmetric to each other.

In some embodiments, a respective engaging member in the first and second engaging members includes a middle portion, a first gripping portion at a first side of the middle portion, and a second gripping portion at a second side of the middle portion. The first gripping portion, the middle portion and the second gripping portion collectively form an opening to accommodate the first leg of a corresponding bedstead in the first and second bedsteads.

In an embodiment, an angle formed between the middle portion and the first or second gripping portion of the respective engaging member is not greater than 90°.

In some embodiments, the first gripping portion includes a first finger and a second finger spaced apart along a length direction of the first leg, with a gap in-between to accommodate a link bar connected with the first leg of the corresponding bedstead. In an embodiment, each of the first and second fingers includes a free end portion bending toward an interior of the respective engaging member and then away from the interior of the respective engaging member.

In some embodiments, the second gripping portion includes a third finger and a fourth finger spaced apart along a length direction of the first leg. The first link member has an edge integrally formed with the middle portion of the respective engaging member between the third and fourth fingers. In an embodiment, each of the third and fourth fingers includes a free end portion bending toward an interior of the respective engaging member and then away from the interior of the respective engaging member.

In an embodiment, the first leg connection member is formed by pressing and bending a sheet of material, or by molding of a plastic.

In some embodiments, the first leg of the first bedstead includes a first slot to accommodate the first engaging member, and the first leg of the second bedstead includes a second slot aligned with the first slot when the folding bed is in the unfolded state to accommodate the second engaging member. In an embodiment, the first leg connection member is made of a rod, with each of the first and second engaging members bended with respect to the first link member. In an embodiment, the first slot and the second slot are substantially the same.

In some embodiments, the first slot and the second slot face a same common direction when the folding bed is in the unfolded state. Each of the first and second engaging members includes a free end portion and an intermediate portion between the free end portion and the first link member. The intermediate portion is bended and insertable into the first or second slot, with the free end portion disposed outside of the first or second slot to assist in disengaging the bent intermediate portion from the first or second slot. In an embodiment, the free end portion is bended in a plane different than a plane defined by the bent intermediate portion.

In some further embodiments, the first slot and the second slot face toward each other when the folding bed is in the unfolded state. Each of the first and second engaging members is formed of a substantially "n" shape, and includes a free end portion and an intermediate portion between the free end portion and the first link member. When engaged, the free end portion is inserted into the first or second slot and the intermediate portion is disposed outside of the first or second slot, such that the first engaging member is hung on a wall of the first leg of the first bedstead, and the second engaging member is hung on a wall of the first leg of the second bedstead.

In an embodiment, an opening of the "n"-shaped first engaging member is not less than a thickness of the wall of the first leg of the first bedstead, and an opening of the "n"-shaped second engaging member is not less than a thickness of the wall of the first leg of the second bedstead. In an embodiment, a height of the "n"-shaped first engaging member is not less than a height of the first slot in the first leg of the first bedstead, and a height of the "n"-shaped second engaging member is not less than a height of the second slot in the first leg of the second bedstead. In a further embodiment, a distance between an opening of the "n"-shaped first engaging member and an opening of the "n"-shaped second engaging member is substantially the same as a distance between the first leg of the first bedstead and the first leg of the second bedstead.

In some embodiments, the one or more connection members include a second leg connection member to couple a second leg of the first bedstead with a second leg of the second bedstead disposed adjacent to each other when the folding bed is in the unfolded state. The second leg connection member includes a third engaging member configured to removeably couple with the second leg of the first bedstead, a fourth engaging member configured to removeably couple with the second leg of the second bedstead, and a second link member connecting the first and second members. The third engaging member, the second link member and the forth engaging member are integrally formed in one unit. When engaged, the second leg connection member restricts a relative movement of the second leg of the first bedstead and the second leg of the second bedstead with respect to each other.

In an embodiment, when the folding bed is in the unfolded state, the first legs of the first and second bedsteads and the second legs of the first and second bedsteads are disposed at opposite sides of the folding bed.

In many embodiments, a bed frame of the present invention includes one or more frame connection members. The one or more frame connection members are disposed between the first bedstead and the second bedstead when the folding bed is in the unfolded state, and configured to couple a first peripheral bar of the first bedstead with a first peripheral bar of the second bedstead disposed adjacent and substantially parallel to each other when the folding bed is in the unfolded state. Corresponding to each respective bedstead in the first and second bedsteads, each frame connection member includes a horizontal member, a first vertical end portion and a second vertical end portion. The horizontal member is configured to abut a top surface or a bottom surface of the first peripheral bar of the respective bedstead. The first vertical end portion is formed at a first edge of the horizontal member, and to be disposed at an internal side of the respective bedstead. The second vertical end portion is formed at an opposite second edge of the horizontal member, and to be disposed at the internal side of the respective bedstead.

In some embodiments, each respective vertical end portion in the first and second vertical end portions includes a bent protrusion configured to extend towards an interior of the frame connection member. In an embodiment, the first and second vertical end portions are spaced apart with a gap in-between to accommodate an end of a crossbar in the plurality of crossbars of the respective bedstead. In an embodiment, an angle formed between the horizontal member and each respective vertical end portion is not greater than 90°

In some embodiments, the horizontal member is recessed downwardly towards the bent protrusion to form a groove, and the first peripheral bar of the respective bedstead is disposed between a first side of the groove and the respective vertical end portion. In an embodiment, an angle formed between the horizontal member and the first side of the groove is not greater than 90°.

In an embodiment, a respective frame connection member in the one or more frame connection members is formed by pressing and bending a sheet of material, by molding of a plastic, or by bending a rod.

In some embodiments, the folding bed further includes a back frame and a plurality of back-frame connection members configured to couple the back frame with the first and second bedsteads.

In some embodiments, the frame of each of the first and second bedsteads includes a second peripheral bar. When the folding bed is in the unfolded state, the second peripheral bar of the frame of the first bedstead is aligned with the second peripheral bar of the frame of the second bedstead, The plurality of back-frame connection members is configured to couple the back frame with the second peripheral bars of the frames of the first and second bedsteads.

In an embodiment, the back frame includes a first back sub-frame and a second back sub-frame. The first back sub-frame is coupled with the second peripheral bar of the frame of the first bedstead, and the second back sub-frame coupled with the second peripheral bar of the frame of the second bedstead by the plurality of back-frame connection members. In an embodiment, the first and second back sub-frames are substantially the same and disposed symmetrically with respect to each other.

In an aspect, the present invention provides a folding bed including a first bedstead disposed on a first side and a second bedstead disposed on a second side of the folding bed. Each of the first bedstead and the second bedstead includes a frame and a plurality of crossbars. The frame defines an interior and includes a first peripheral bar. When the folding bed is in an unfolded state, the first peripheral bar of the frame of the first bedstead is disposed adjacent and substantially parallel to the first peripheral bar of the frame of the second bedstead. The plurality of crossbars disposed in a common direction in the interior defined by the frame and coupled to the frame. The folding bed also includes one or more frame connection members disposed between the first bedstead and the second bedstead when the folding bed is in the unfolded state. The one or more frame connection members are configured to couple the first peripheral bar of the frame of the first bedstead with the first peripheral bar of the frame of the second bedstead. Corresponding to each respective bedstead in the first and second bedsteads, each frame connection member includes a horizontal member, a first vertical end portion and a second vertical end portion. The horizontal member is configured to abut a top surface or a bottom surface of the first peripheral bar of the respective bedstead. The first vertical end portion is formed at a first edge of the horizontal member, and to be disposed at an internal side of the respective bedstead. The second vertical end portion is formed at an opposite second edge of the horizontal member, and to be disposed at the internal side of the respective bedstead.

In another aspect, the present invention provides a folding bed including a first bedstead disposed on a first side and a second bedstead disposed on a second side of the folding bed. Each of the first bedstead and the second bedstead includes a frame, a plurality of crossbars and a plurality of legs. The frame defines an interior and includes a first peripheral bar. When the folding bed is in an unfolded state, the first peripheral bar of the frame of the first bedstead is disposed adjacent and substantially parallel to the first peripheral bar of the frame of the second bedstead. The plurality of crossbars is disposed in a common direction in the interior defined by the frame and coupled to the frame. The plurality of legs is coupled with the frame or one or more of the crossbars, and includes a first leg. When the folding bed is in the unfolded state, the first leg of the first bedstead is disposed adjacent and substantially parallel to the first leg of the second bedstead. The folding bed also includes one or more frame connection members disposed between the first bedstead and the second bedstead when the folding bed is in the unfolded state. The one or more frame connection members are configured to couple the first peripheral bar of the frame of the first bedstead with the first peripheral bar of the frame of the second bedstead. The folding bed further includes a first leg connection member configured to couple the first leg of the first bedstead with the first leg of the second bedstead. The first leg connection member includes a first engaging member configured to removeably couple with the first leg of the first bedstead, a second engaging member configured to removeably couple with the first leg of the second bedstead, and a first link member connecting the first and second engaging members. The first engaging member, the first link member and the second engaging member are integrally formed in one unit. When engaged, the first leg connection member restricts a relative movement of the first leg of the first bedstead and the first leg of the second bedstead with respect to each other.

In a further aspect, the present invention provides a leg connection member of a folding bed. The folding bed includes a first bedstead disposed on a first side and a second bedstead disposed on a second side of the folding bed. Each of the first bedstead and the second bedstead includes a first leg. When the folding bed is in an unfolded state, the first leg of the first bedstead is disposed adjacent and substantially parallel to the first leg of the second bedstead. the leg connection member includes a first engaging member removeably coupling with the first leg of the first bedstead, a second engaging member removably coupling with the first leg of the second bedstead, and a first link member connecting the first and second engaging members. The first engaging member, the first link member and the second engaging member are integrally formed in one unit. A respective engaging member in the first and second engaging members includes a middle portion, a first gripping portion at a first side of the middle portion and a second gripping portion at a second side of the middle portion. The first gripping portion, the middle portion and the second gripping portion collectively form an opening to accommodate the first leg of a corresponding bedstead in the first and second bedsteads. When coupled, the first leg connection member restricts a relative movement of the first leg of the first bedstead and the first leg of the second bedstead with respect to each other.

In a still further aspect, the present invention provides a leg connection member of a folding bed. The folding bed includes a first bedstead disposed on a first side and a second bedstead disposed on a second side of the folding bed. Each of the first bedstead and the second bedstead includes a first leg. The first leg of the first bedstead includes a first slot and the first leg of the second bedstead includes a second slot. When the folding bed is in an unfolded state, the first slot of the first leg of the first bedstead is aligned with the second slot of the first leg of the second bedstead. The leg connection member includes a first engaging member configured to removeably couple with the first slot of the first leg of the first bedstead, a second engaging member configured to removeably couple with the second slot of the first leg of the second bedstead, and a first link member connecting the first and second engaging members. The first engaging member, the first link member and the second engaging member are integrally formed in one unit. When coupled, the first leg connection member restricts a relative movement of the first leg of the first bedstead and the first leg of the second bedstead with respect to each other.

The connection members and the folding beds of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

In the figures, reference numbers refer to the same or equivalent parts of the present invention throughout the several figures of the drawing.

DETAILED DESCRIPTION

Figure 1:
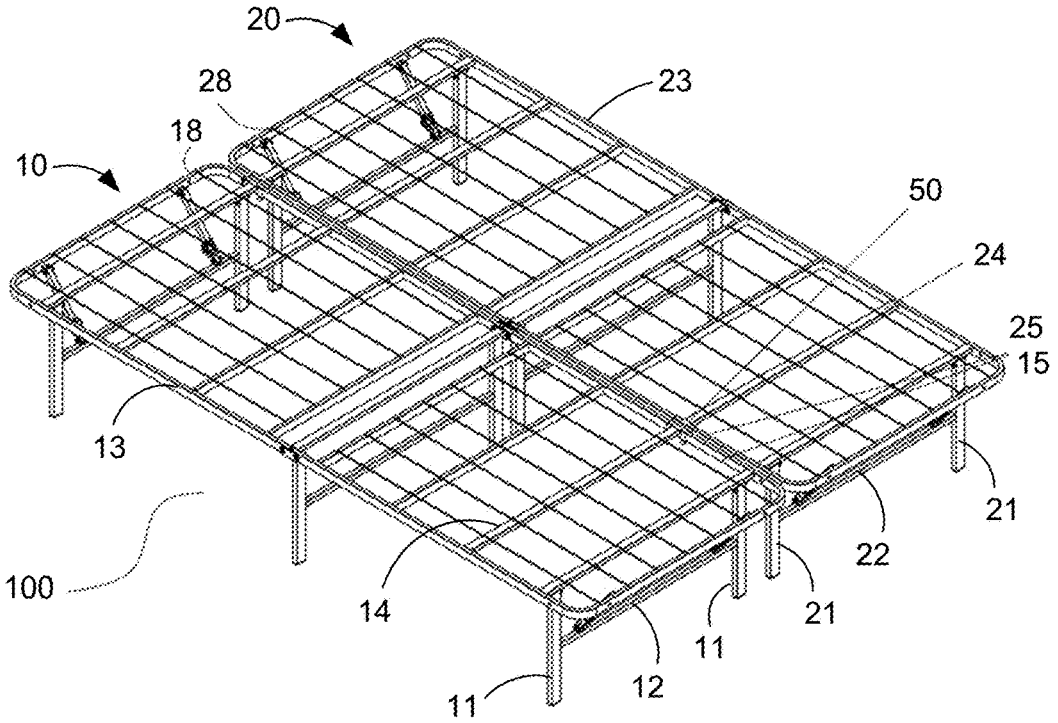
FIG. 1 is a schematic perspective view illustrating a first exemplary folding bed in accordance with some embodiments of the present invention.

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only.

Embodiments of the present invention are described in the context of folding beds. In general, a folding bed of the present invention includes a first bedstead, a second bedstead, and one or more connection members configured to couple the first and second bedsteads. The one or more connection members facilitate easy and quick assembling and dissembling of the folding bed. Once coupled, the one or more connection members engage the first bedstead firmly with the second bedstead, and thus reduce the risk of bending the folding bed when lifting up either the first or the second bedstead. The one or more connection members also assist in stabilizing the folding bed. Accordingly, the folding bed of the present invention is more stable and has an improved service life.

A connection member in the one or more connection members can be either frame connection member configured to couple a frame of the first bedstead with a frame of the second bedstead or leg connection member configured to couple a leg of the first bedstead with a leg of the second bedstead. The frame connection member and the leg connection member of the present invention can work together or independently from each other. For instance, in an embodiment, a folding bed of the present invention includes only frame connection member(s). In another embodiment, a folding bed of the present invention includes only leg connection member(s). In a further embodiment, a folding bed of the present invention includes both of the frame and leg connection members.

Referring now to FIG. 1, there is depicted an exemplary folding bed in accordance with some embodiments of the present invention. As shown, folding bed 100 includes a first bedstead such as first bedstead 10 disposed on a first side and a second bedstead such as second bedstead 20 disposed on a second side of folding bed 100. Each of first bedstead 10 and second bedstead 20 includes a frame (e.g., frame 13 or frame 23) and a plurality of crossbars (e.g., crossbars 14 or crossbars 24). The frame defines an interior, in which the plurality of crossbars is disposed and coupled to the frame. In an embodiment, the plurality of crossbars is disposed in a common direction. The frame also includes a peripheral bar, for instance, frame 13 including first peripheral bar 15 and frame 23 including first peripheral bar 25. When the folding bed is in an unfolded state, the first peripheral bar of the frame of first bedstead 10 is disposed adjacent and substantially parallel to the first peripheral bar of the frame of second bedstead 20.

In some embodiments, each of first bedstead 10 and second bedstead 20 includes a plurality of legs coupled to the frame or the crossbars. For instance, first bedstead 10 includes a plurality of legs 11 and second bedstead includes a plurality of legs 21. When the folding bed is in an unfolded state, one or more legs in the plurality of legs 11 of first bedstead 10 are disposed adjacent and substantially parallel to one or more legs in the plurality of legs 21 of second bedstead 20, respectively. For instance, FIG. 1 illustrates three legs of first bedstead 10 in the middle of the folding bed, each of which is adjacent and substantially parallel to a leg of second bedstead 20, and vice versa.

In various embodiments, folding bed 100 also includes one or more connection members to couple the first bedstead with the second bedstead, providing a combined and stable bed to support a mattress. each of the one or more connection members can be either a frame connection member, or a leg connection member. By way of illustration, FIG. 1 shows folding bed 100 including one or more flame connection members 50 configured to couple frame 13 of first bedstead 10 with frame 23 of second bedstead 20.

Figure 2:
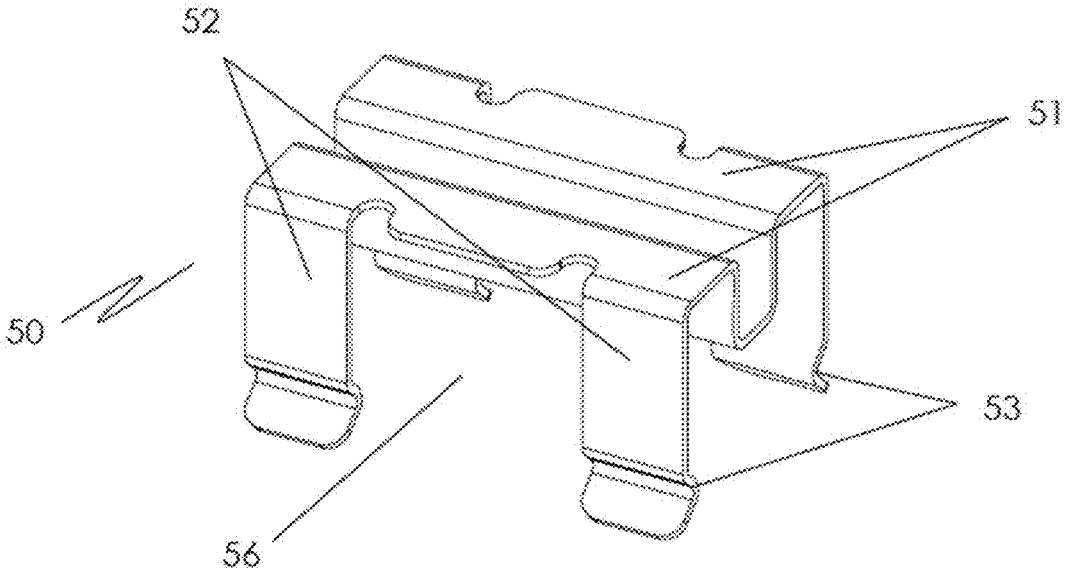
FIG. 2 is a schematic perspective view illustrating an exemplary frame connection member in accordance with some embodiments of the present invention.
Figure 3:
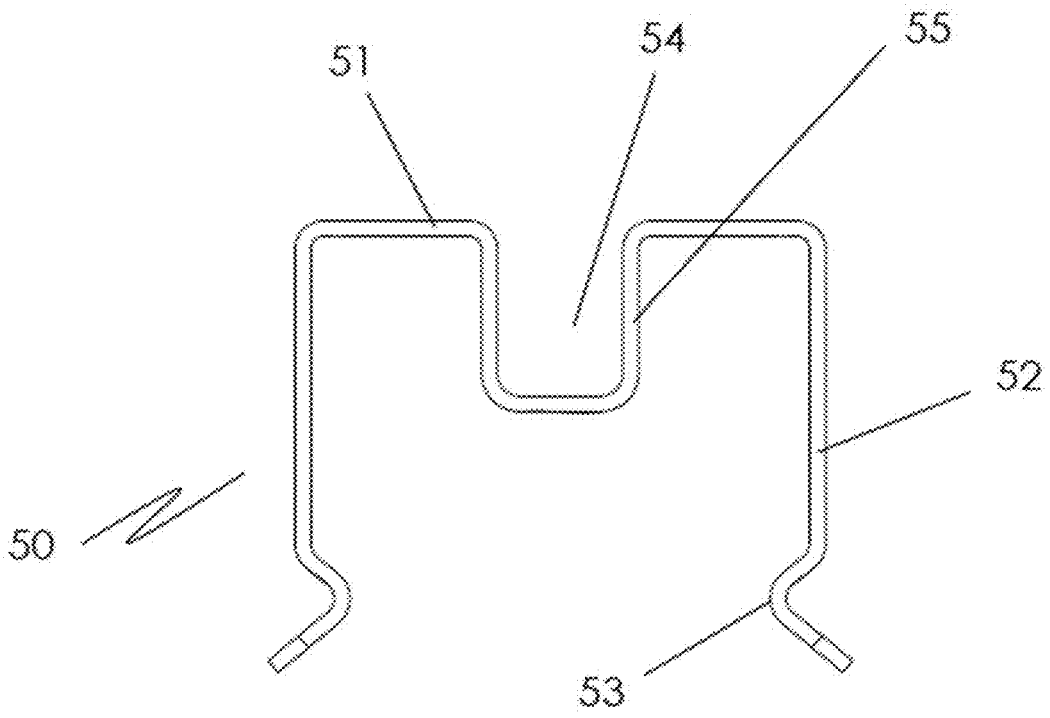
FIG. 3 is a schematic side view illustrating the frame connection member of FIG. 2.

Referring to FIG. 2 and FIG. 3, in some exemplary embodiments, corresponding to each of the first and second bedsteads, frame connection member 50 includes horizontal member 51, first vertical end portion 52, and second vertical end portion 52. The first vertical end portion is disposed on a first edge of the horizontal member, and the second vertical end portion is disposed on an opposite second edge of the horizontal member. In the embodiment illustrated in FIG. 1, horizontal member 51 is disposed above the first peripheral bar of frame 13 or 23 and each of vertical end portions 52 is disposed at an internal side of first bedstead 10 or second bedstead 20. As such, frame connection member 50 couples the two first peripheral bars of the first and second bedsteads together.

In some exemplary embodiments, each respective vertical end portion 52 is provided a bent protrusion 53 extending towards an interior of frame connection member 50. The bent protrusions 53 are configured to clamp to the first peripheral bar of the frame (e.g., frame 13 or frame 23), thereby preventing frame connection member 50 from disengaging during use. In the illustrated embodiment, horizontal member 51 abuts a top surface of the first peripheral bar of the frame and bent protrusion 53 abuts a bottom surface of the first peripheral bar of the frame; however, the present invention is not limited thereto. For instance, in another embodiment, horizontal member 51 abuts a bottom surface of the first peripheral bar of the frame and bent protrusion 53 abuts a top surface of the first peripheral bar of the frame.

In some exemplary embodiments, horizontal member 51 is recessed downwardly towards bent protrusion 53 to form groove 54. Groove 54 spans from a third edge to a fourth edge of horizontal member 51. The first peripheral bar of each respective bedstead is located between first side 55 of groove 54 and the respective vertical end portion 52. The distance between first side 55 and the respective vertical end portion 52 is approximately the same as the width of the first peripheral bar of the frame. In the present case, the frame can be stabilized in a horizontal direction while simultaneously being stabilized in a vertical direction, thereby ensuring that folding bed 100 does not shake or is unbalanced during use. In addition, the disposition of frame connection member 50 corresponds to the peripheries of the frames, with groove 54 to fill a separation formed between the frames of the first and second bedsteads. As such, groove 54 helps to ensure that folding bed 100 is stable.

In some embodiments, first and second vertical end portions 52 are spaced apart with gap 56 in-between to accommodate a crossbar (e.g., an end of the crossbar) in the plurality of crossbars (e.g., crossbar 14 or crossbar 24) of the respective bedstead. The crossbar in gap 56 prevents frame connection member 50 from sliding along the first peripheral bar of the frame during use, thereby improving the stability of folding bed 100.

To generate a sufficient clamping force between frame connection member 50 and the first peripheral bar of the frame, in some embodiments, an angle formed between horizontal member 51 and each respective vertical end portion 52 is not greater than 90°. Similarly, in some embodiments, an angle formed between horizontal member 51 and first side 55 of groove 54 is not greater than 90°.

Frame connection member 50 can include additional or optional features. For instance, in an embodiment, a chamfer edge is formed between horizontal member 51 and each respective vertical end portion 52. In another embodiment, a round edge is formed between horizontal member 51 and each respective vertical end portion 52.

Figure 4:
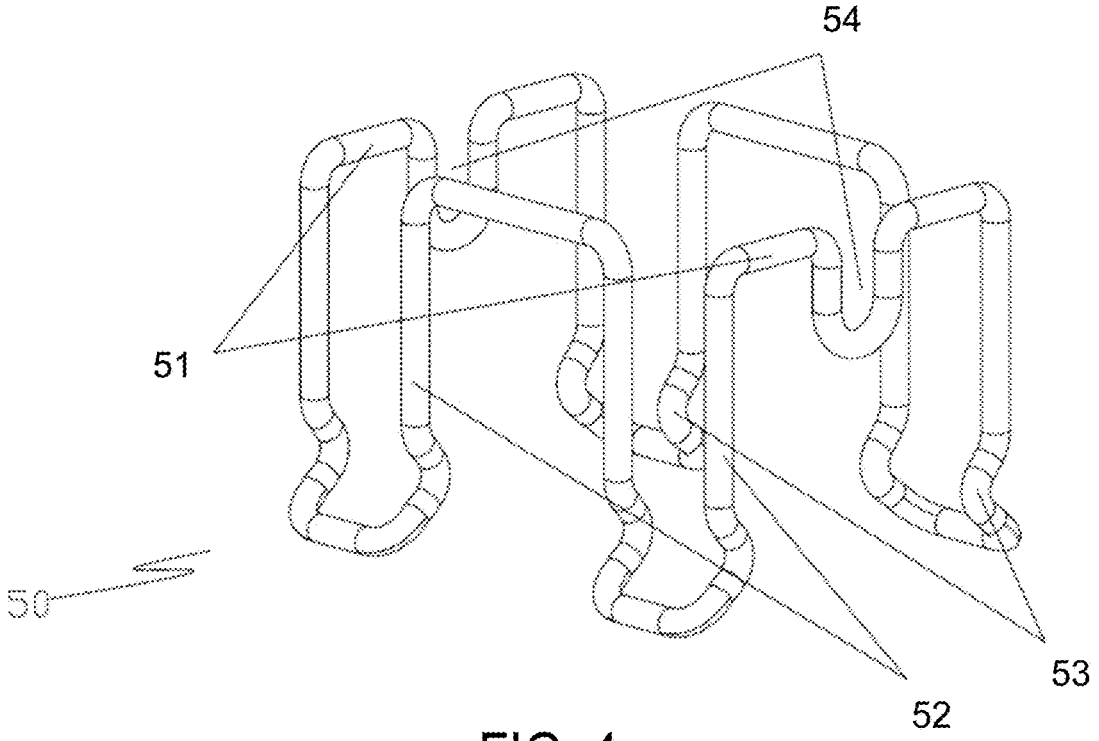
FIG. 4 is a schematic perspective view illustrating an exemplary alternative frame connection member in accordance with some embodiments of the present invention.
Figure 10:
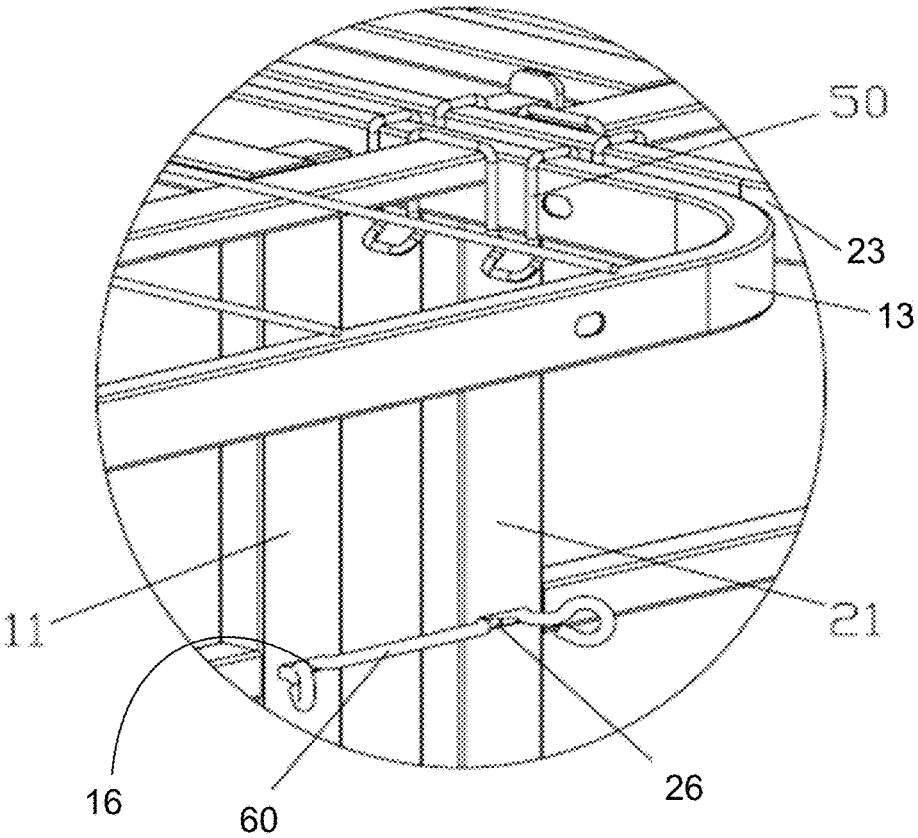
FIG. 10 is a partially enlarged view taken along circle A of FIG. 9.

Frame connection member 50 can be made by a sheet of material, a plastic or a rod, or any other suitable material. For instance, in the embodiment illustrated in FIGS. 2 and 3, frame connection member 50 is formed by pressing and bending a sheet of material, or by molding of a plastic material. In the embodiment illustrated in FIGS. 4 and 10, frame connection member 50 is of a bent rod piece, for instance, formed by bending a rod.

Figure 5:
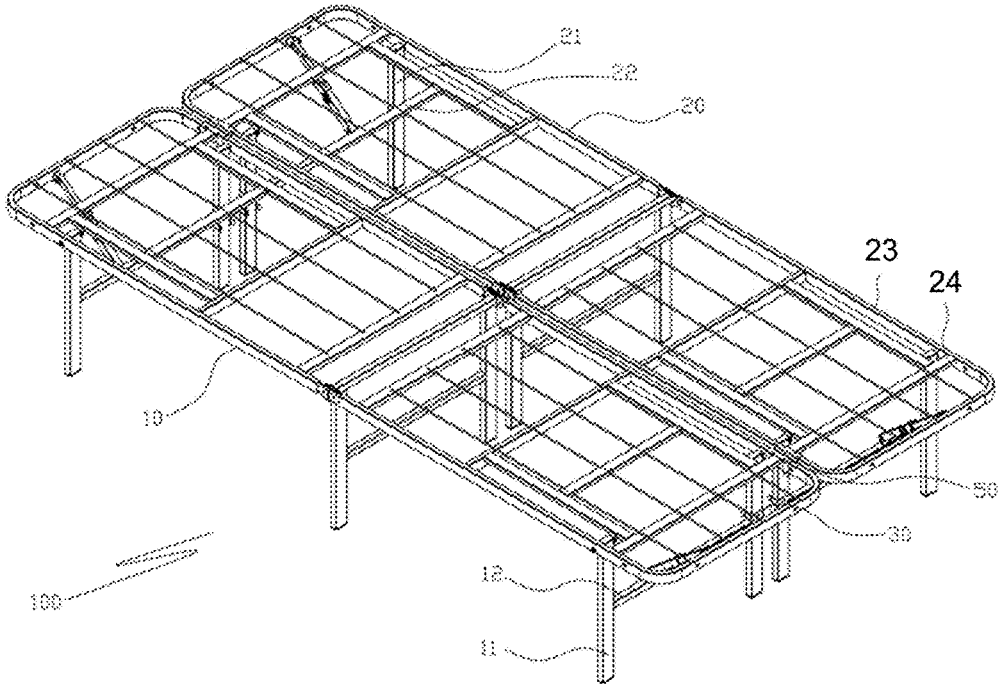
FIG. 5 is a schematic perspective view illustrating a second exemplary folding bed folding bed in accordance with some embodiments of the present invention.
Figure 9:
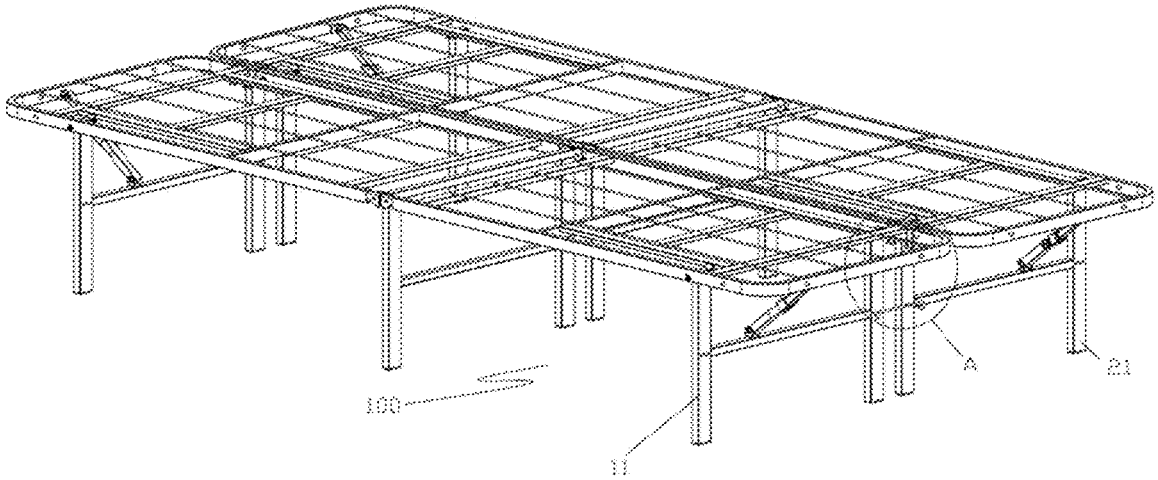
FIG. 9 is a schematic perspective view illustrating a third exemplary folding bed in accordance with some embodiments of the present invention.
Figure 13:
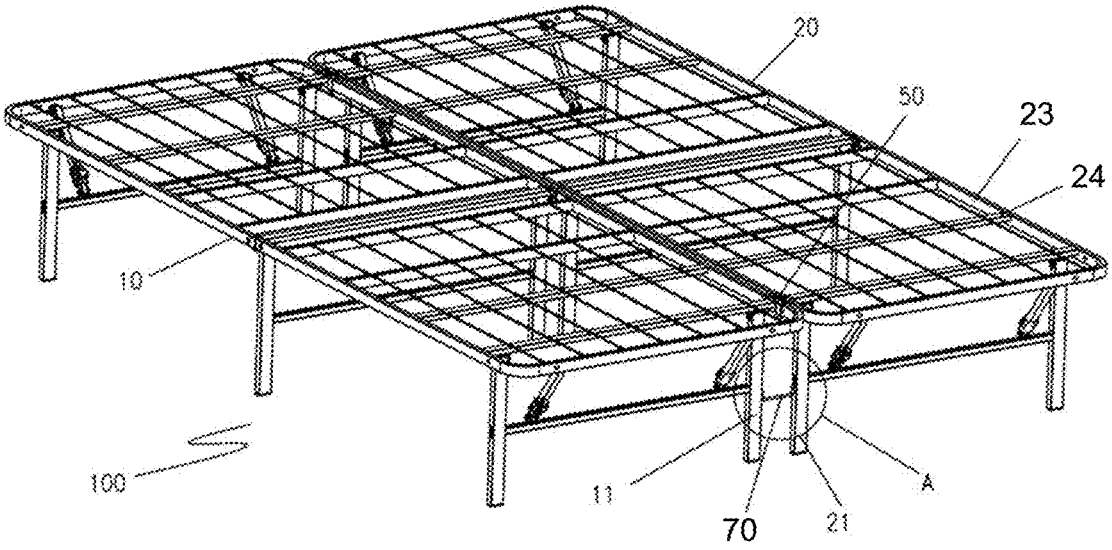
FIG. 13 is a schematic perspective view illustrating a fourth exemplary folding bed in accordance with some embodiments of the present invention.
Figure 14:
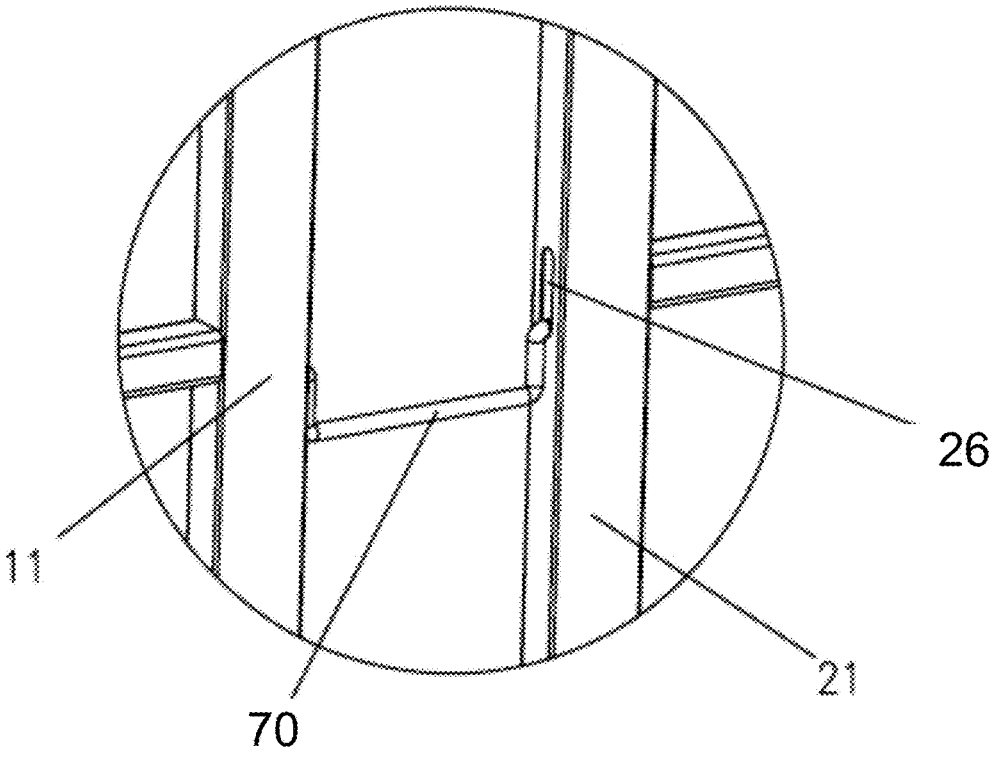
FIG. 14 is a partially enlarged view taken along circle A of FIG. 13.
Figure 15:
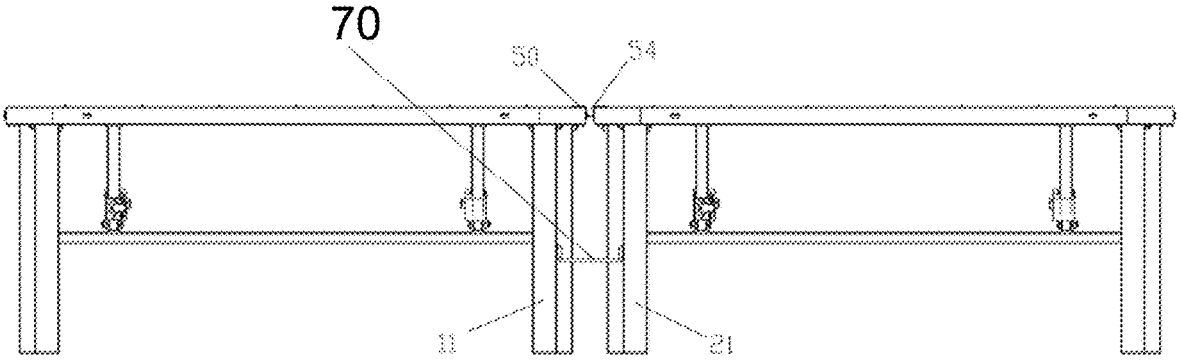
FIG. 15 is a schematic side view illustrating the fourth exemplary folding bed of FIG. 13.
Figure 16:
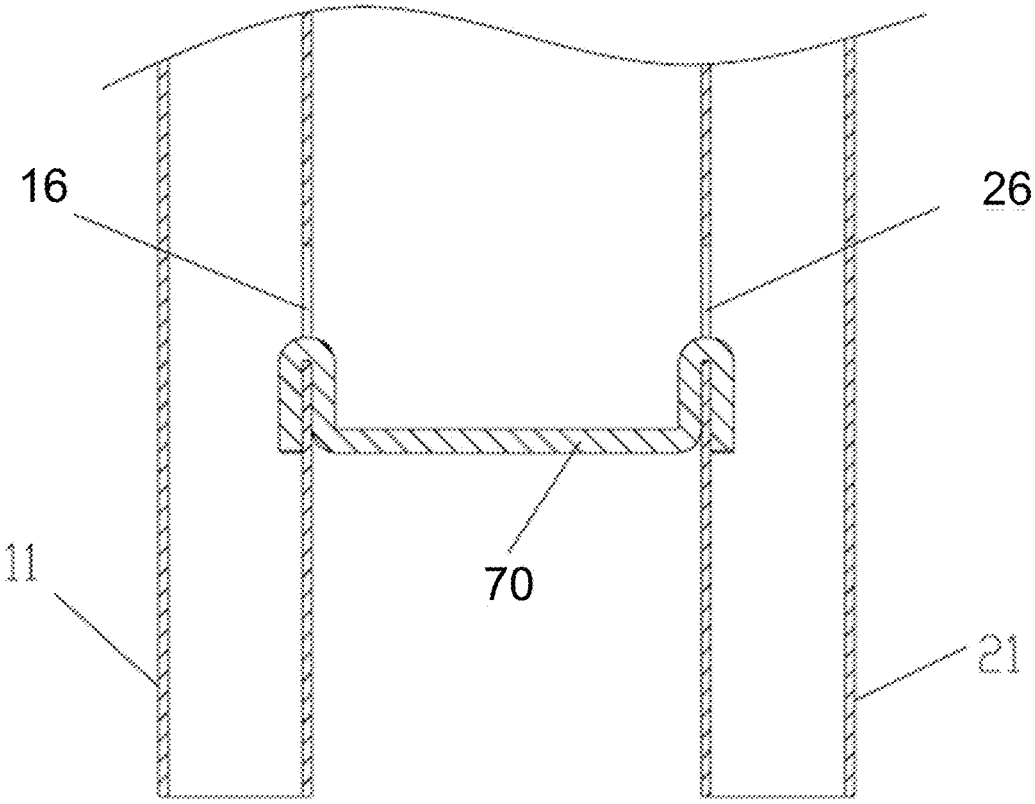
FIG. 16 is a schematic cross-sectional view illustrating a third exemplary leg connection member in accordance with some embodiments of the present invention.

Referring to FIGS. 5, 9 and 13, in many embodiments, folding bed 100 includes one or more leg connection members (such as leg connection member 30, 60, 70) each configured to couple a leg of the first bedstead with an adjacent leg of the second bedstead. It should be noted that although FIGS. 5, 9 and 13 illustrate the use of the leg connection member along with the frame connection member, a folding bed of the present invention can but does not unnecessarily have to have both types of connection members. The frame connection member and the leg connection member of the present invention can work independently from each other or complementarily to each other.

To connect adjacent two legs, a leg connection member of the present invention generally includes a first engaging member and a second engaging member. To facilitate easy and quick assembling and disassembling the folding bed, the first engaging member is configured to removably couple with a leg of the first bedstead, and the second engaging member is configured to removably couple with an adjacent leg of the second bedstead. The first and second engaging members is connected or joined with each other by a link member. When engaged, the leg connection member restricts the leg of the first bedstead from moving with respect to the leg of the second bedstead.

In many embodiments, the first engaging member, the link member and the second engaging member are integrally formed in one unit, for instance, by molding of a plastic, by bending of a sheet material, by bending of a rod, or the like. The first and second engaging members can be configured the same or differently from each other. In some embodiments, the first and second engaging members are configured substantially the same and disposed substantially symmetric to each other.

Figure 6:
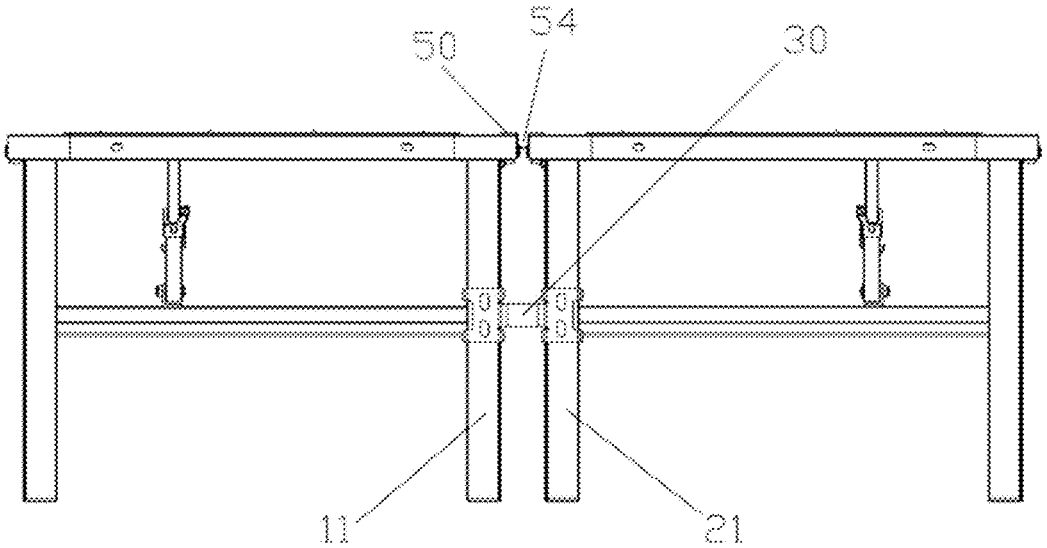
FIG. 6 is a schematic side view illustrating the second exemplary folding bed folding bed of FIG. 5.
Figure 7:
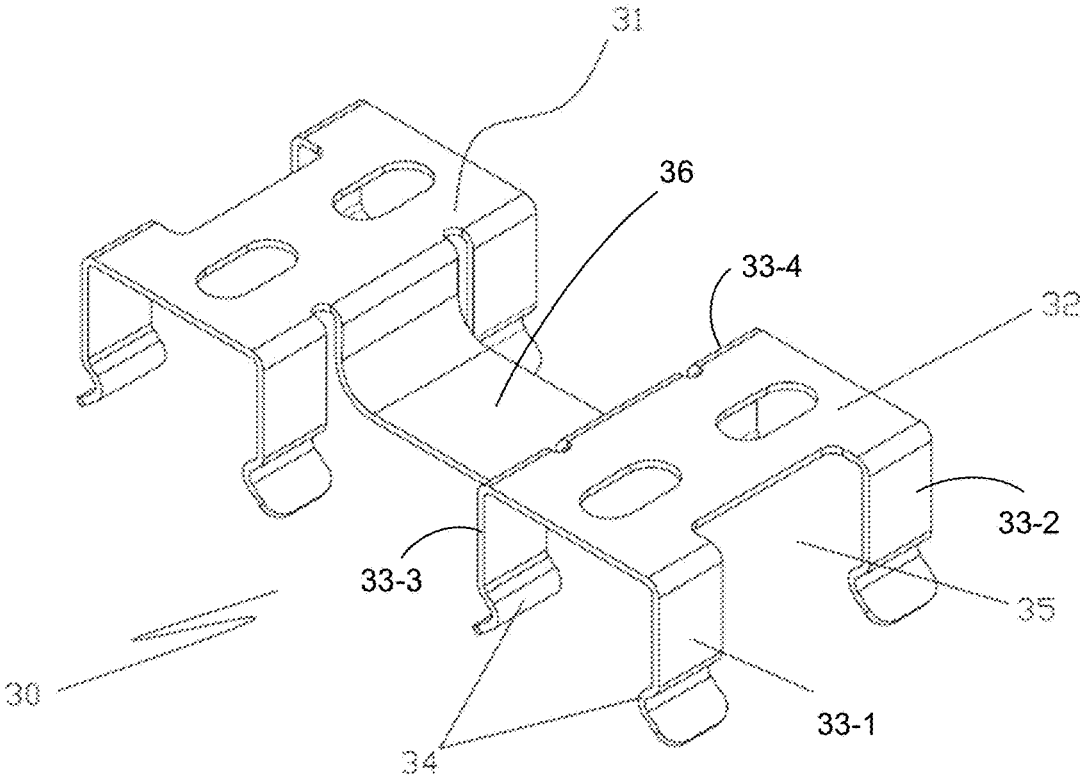
FIG. 7 is schematic perspective view illustrating a first exemplary leg connection member in accordance with some embodiments of the present invention.
Figure 8:
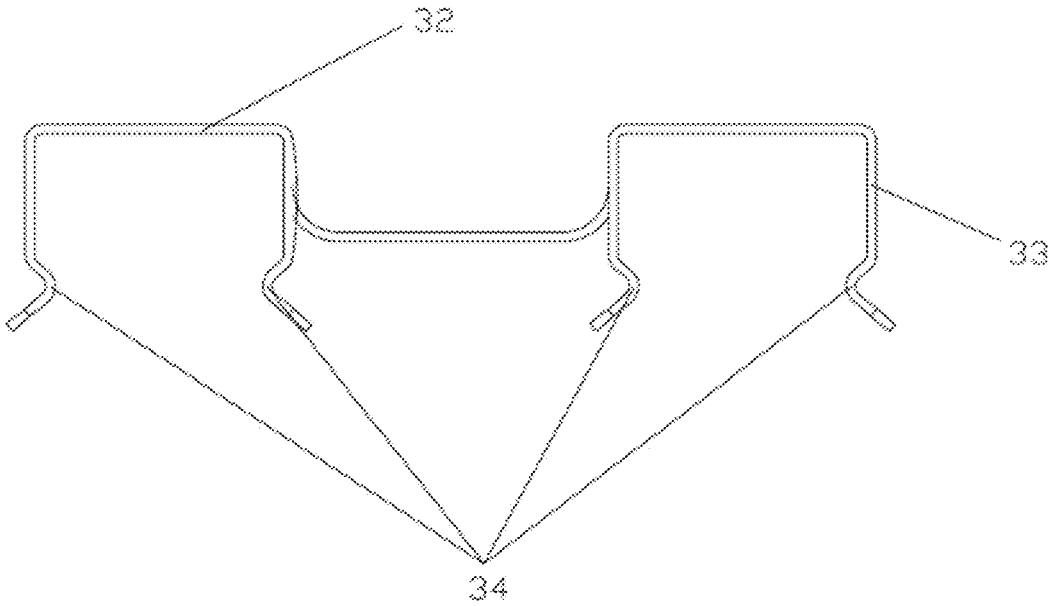
FIG. 8 is a schematic side view illustrating the first exemplary leg connection member of FIG. 7.

Referring to FIGS. 6-8, there is depicted a first exemplary leg connection member in accordance with some embodiments of the present invention. As shown, leg connection member 30 includes first and second engaging members 31 connected by link member 36. First engaging member 31 is configured to removeably couple with leg 11 of first bedstead 10, for instance, by grasping the leg of the first bedstead. Similarly, second engaging member 31 configured to removeably couple with leg 21 of second bedstead 20. In the illustrated embodiment, each of first and second engaging members 31 includes a middle portion such as middle portion 32, and first and second gripping portions 33 at first and second sides of middle portion 32. It should be noted that the first and second gripping portions can be configured the same or differently from each other in terms of the shape, size or the like. By way of example, FIGS. 7 and 8 illustrates substantially the same first and second gripping portions.

The first gripping portion, the middle portion and the second gripping portion form an opening to accommodate leg 11 of the first bedstead or leg 21 of the second bedstead.

The opening usually resembles the cross-sectional profile or contour of of the leg, which can be a circle, an oval, a rectangle, or any other shape. In some embodiments, the combination of the first gripping portion, the middle portion and the second gripping portion wraps around at least half of the leg circumferentially.

FIGS. 7 and 8 illustrate the first gripping portion, the middle portion and the second gripping portion collectively forming a substantially rectangular opening. In some embodiments, to assist in gripping the leg, an angle formed between the middle portion and the first or second gripping portion is not greater than 90°.

Figure 12:
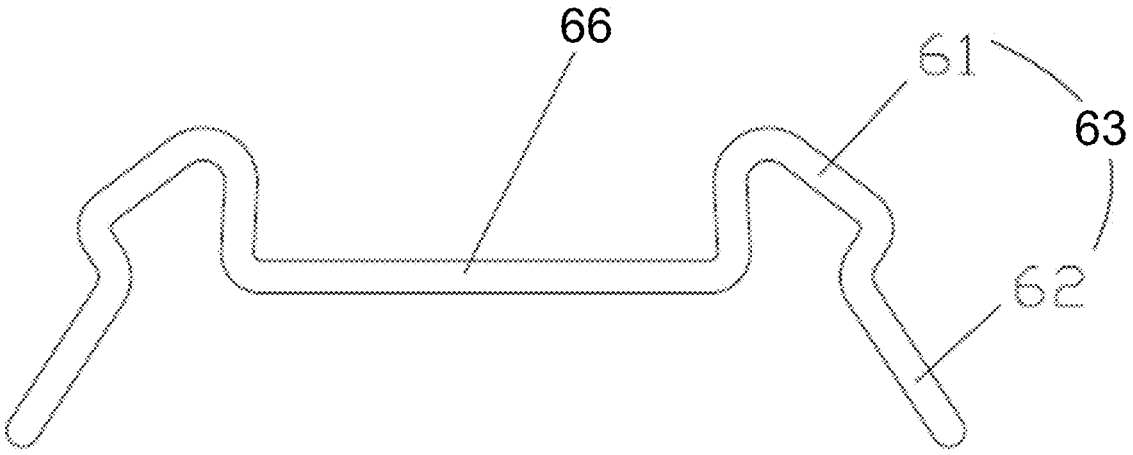
FIG. 12 is a schematic view illustrating an exemplary variation of the second leg connection member in accordance with some embodiments of the present invention.

In some embodiments, the first gripping portion includes more than one finger, such as first finger 33-1 and second finger 33-2, spaced apart along a length direction of the leg when engaged with the leg. A gap is formed between first finger 33-1 and second finger spaced 33-2, which can be used to accommodate a link bar connected with the leg of the first or second bedstead. For instance, FIG. 12 illustrates link bar 12 connecting two legs 11 of the first bedstead and link bar 22 connecting two legs 21 of the second bedstead. The link bar in the gap prevents leg connection member 30 from sliding along leg 11 or leg 21 during use, thereby improving the stability of folding bed 100.

Similarly, in some embodiments, the second gripping portion includes more than one finger, such as third finger 33-3 and fourth finger 33-4 spaced apart from each other. In an embodiment, first link member 36 has an edge integrally formed with middle portion 32 of engaging member 31 between third finger 33-3 and fourth finger 33-4 as illustrated in FIG. 7.

In some embodiments, at least one of the first, second, third or fourth fingers includes a free end portion such as end portion 34 bending toward an interior of engaging member 31 and then away from the interior of engaging member 31. In an embodiment, each of the first, second, third or fourth fingers includes bent end portion 34. The bent end portion allows easy and quick coupling of the engaging member with the leg. In addition, it helps to retain the leg in the opening formed by the first gripping portion, the middle portion and the second gripping portion.

Connection member 30 can be made, for example, by molding of a plastic or by bending of a sheet material or the like.

Referring to FIGS. 9-12, there is depicted a second exemplary leg connection member in accordance with some embodiments of the present invention. As shown, leg connection member 60 is a rod-like piece made, for instance, by bending a rod. Like leg connection member 30, leg connection member 60 includes first and second engaging members 63 connected by link member 66. First engaging member 63 is configured to removeably couple with leg 11 of first bedstead 10, and second engaging member 63 configured to removeably couple with leg 21 of second bedstead 20.

Unlike leg connection member 30, first or second engaging member 63 of leg connection member 60 is not configured to wrap around a leg of the first or second bedstead. Instead, it is configured to engage with the leg through a slot formed in the leg. For instance, in the illustrated embodiment, leg 11 of the first bedstead is formed with slot 16 and leg 21 is formed with slot 26. Slot 16 and slot 26 face the same direction, e.g., outwardly away from the head or foot end of the folding bed. In some embodiments, slot 16 and slot 26 are configured substantially the same in terms of the size, shape, location (e.g., on the same elevation), or the like. Such slots ensure good alignment when the folding bed is unfolded.

To engage the leg through the slot, in some embodiments, each of first and second engaging members 63 is bent with respect to link member 66. In some embodiments, each of first and second engaging members 63 includes free end portion 62, and intermediate portion 61 between free end portion 62 and link member 66. Intermediate portions 61 of the first and second engaging members are bended and can be inserted into slot 16 and slot 26, respectively, and thus couple leg 11 of first bedstead 10 with leg 21 of second bedstead 20.

Figure 11:
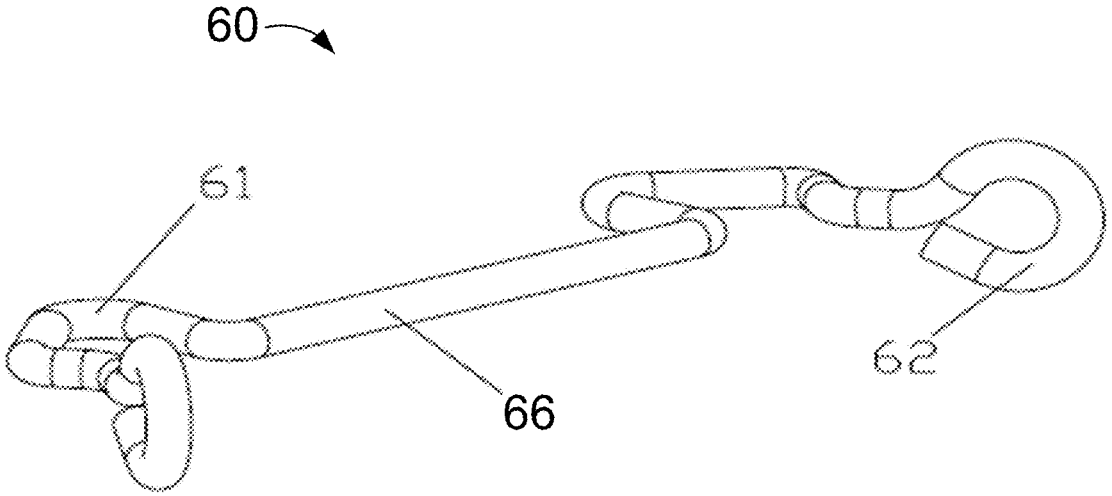
FIG. 11 is a schematic view illustrating a second exemplary leg connection member in accordance with some embodiments of the present invention.

While intermediate portions 61 are inserted into slot 16 and slot 26, free end portions 62 of first and second engaging members 63 are disposed outside of slot 16 and slot 26, respectively. Using free end portions 62, one can easily remove the bent intermediate portions from slot 16 and slot 26. In some embodiments, to further assist in engaging with or disengaging from the slot, free end portion 62 is bended in a plane different than a plane defined by bent intermediate portion 61. In an embodiment, free end portion 62 is bended in a plane substantially perpendicular to a plane defined by the bent intermediate portion as illustrated in FIG. 11.

Referring to FIGS. 13-19, in some embodiments, there is depicted a third exemplary leg connection member in accordance with some embodiments of the present invention. Like leg connection member 30 and leg connection member 60, leg connection member 70 includes first and second engaging members 73 connected by link member 76. First engaging member 73 is configured to removeably couple with leg 11 of first bedstead 10, and second engaging member 73 configured to removeably couple with leg 21 of second bedstead 20.

Like leg connection member 60, leg connection member 70 is a rod-like piece made, for instance, by bending a rod. Also like leg connection member 60, leg connection member 70 is configured to engage with the leg through a slot formed in the leg.

Unlike the embodiment illustrated in 9-10, slot 16 and slot 26 in the present embodiment are not configured to face the same direction, but rather they face toward each other when the folding bed is unfolded. To engage with the legs through such slots, each of first and second engaging members 73 is formed of a substantially "n" shape. The "n" shaped engaging member 73 includes free end portion 72 and intermediate portion 71 between free end portion 72 and link member 76. Free end portion 72 is to be inserted into slot 16 or slot 26 while intermediate portion 71 is disposed outside of slot 16 or slot 26. As such, first engaging member 73 is hung on a wall of leg 11 of the first bedstead, and second engaging member 73 is hung on a wall of leg 21 of the second bedstead.

Figure 17:
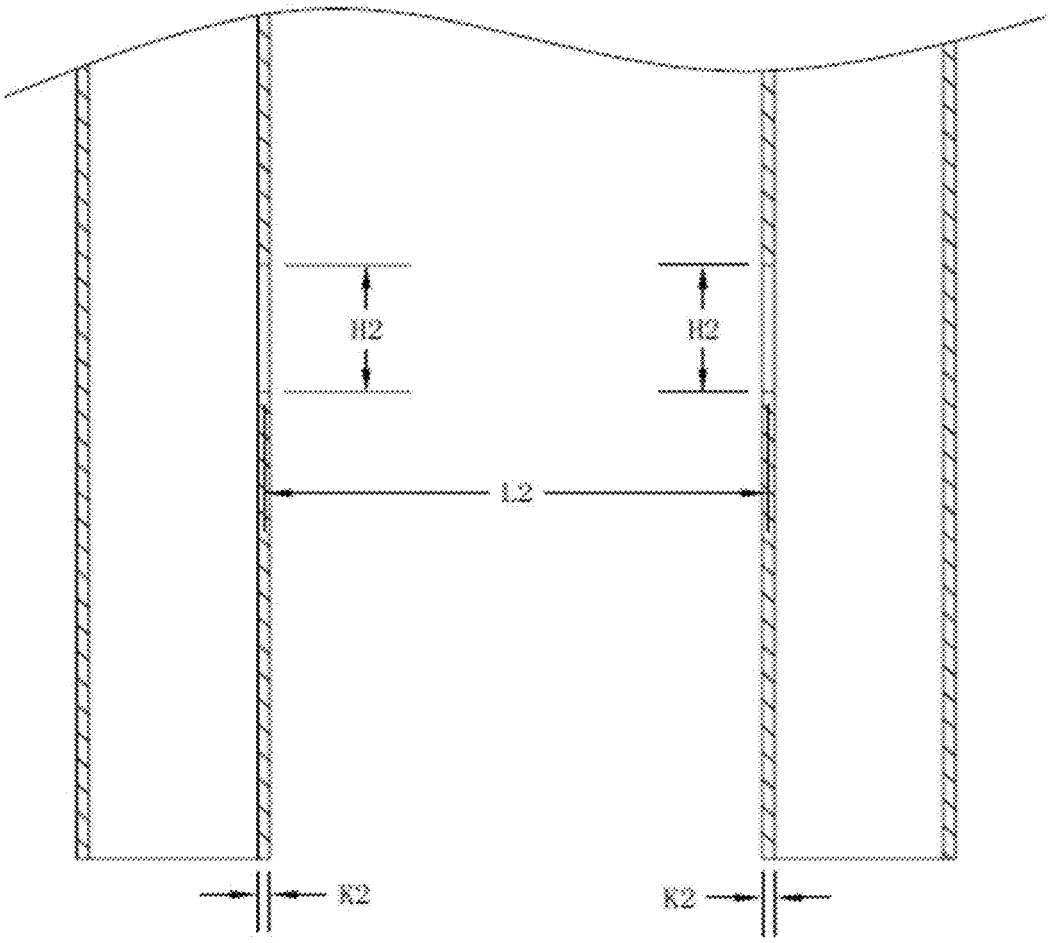
FIG. 17 is a schematic cross-sectional view illustrating adjacent legs of the third exemplary folding bed of FIG. 13.
Figure 18:
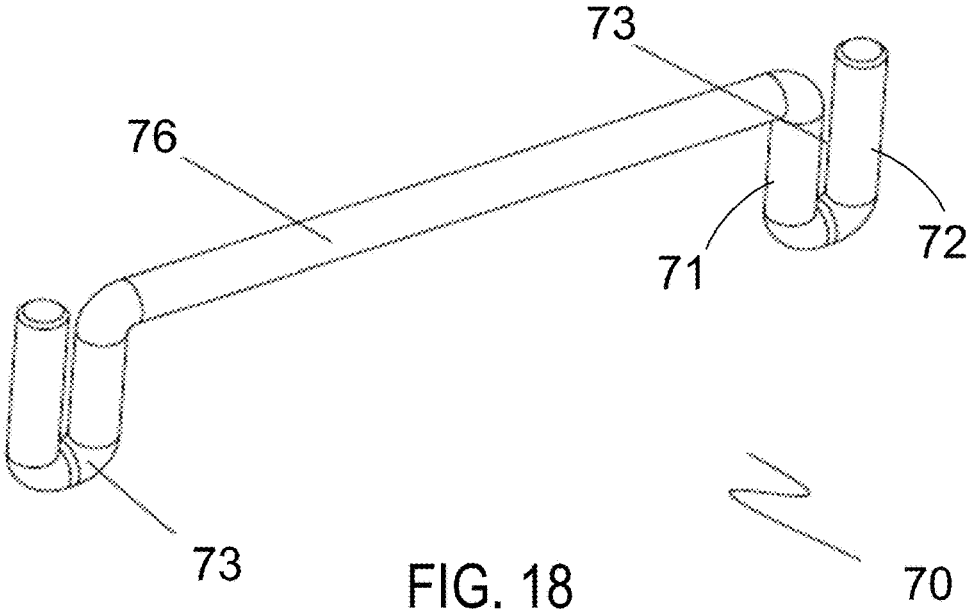
FIG. 18 is a schematic perspective view illustrating the third exemplary leg connection member of FIG. 16.
Figure 19:
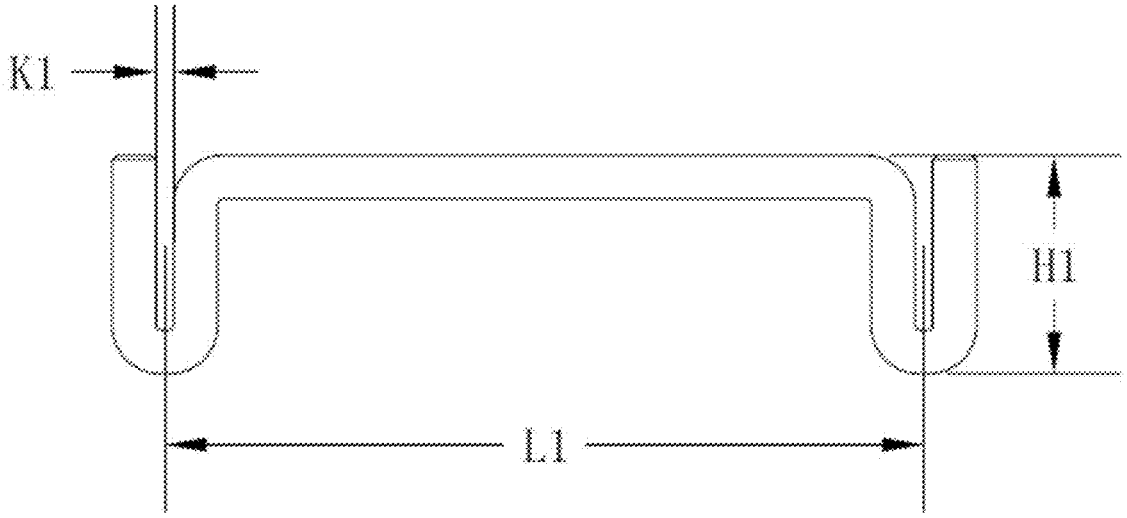
FIG. 19 is a schematic side view illustrating the third exemplary leg connection member of FIG. 16.

In some embodiments, to facilitate the engagement of leg connection member 70 with legs 11 and 12, in some embodiments, the opening of the "n"-shaped first engaging member (e.g., a gap between free end portion 72 and intermediate portion 71) is not less than a thickness of the wall of leg 11 of the first bedstead. Similarly, the opening of the "n"-shaped second engaging member is not less than a thickness of the wall of leg 21 of the second bedstead. It should be noted that the legs of the first and second bedsteads can be configured the same or differently, e.g., with the same thickness or different thicknesses. It should be noted also that the "n"-shaped first and second engaging members can be configured with the same or different openings. By way of example, FIGS. 17 and 19 illustrate legs 11 and 12 of the first and second bedsteads having the same thickness K2, and the "n"-shaped first and second engaging members having the same opening K1, where K1 is not less than K2.

In some embodiments, the height of the "n"-shaped first engaging member is not less than the height of slot 16 formed in leg 11 of the first bedstead, and the height of the "n"-shaped second engaging member is not less than the height of slot 26 formed in leg 21 of the second bedstead. By way of example, FIGS. 17 and 19 illustrate slots 13 and 23 formed in legs 11 and 12 of the first and second bedsteads having the same height H2, and the "n"-shaped first and second engaging members having the same height H1, where H1 is not less than H2. In an embodiment, H1 and H2 are substantially the same.

In an embodiment, K1 and K2 are substantially the same; and distance L1 between the opening of the "n"-shaped first engaging member and the opening of the "n"-shaped second engaging member is substantially the same as distance L2 between leg 11 of the first bedstead and leg 21 of the second bedstead. Such a connection member facilitates tight fitting of the connection member with the legs of the first and second bedsteads and helps to stabilize the folding bed.

It should be noted that a folding bed of the present invention can include more than one leg connection member. For instance, in an embodiment, a folding bed includes a second leg connection member to couple a second leg of the first bedstead with a second leg of the second bedstead. The first legs of the first and second bedsteads and the second legs of the first and second bedsteads can be disposed at opposite sides of the folding bed when the folding bed is in the unfolded state, e.g., one pair of adjacent legs at the head of the folding bed and the other pair of adjacent legs at the foot of the folding bed. It should also be noted that a pair of adjacent legs can but does not unnecessarily have to be coupled by a leg connection member. For instance, in some embodiments, the pair of adjacent legs in the middle between the head and the foot of the folding bed can be coupled or not coupled by a leg connection member. It should be further noted that a folding bed of the present invention can include different types of leg connection members.

Figure 20:
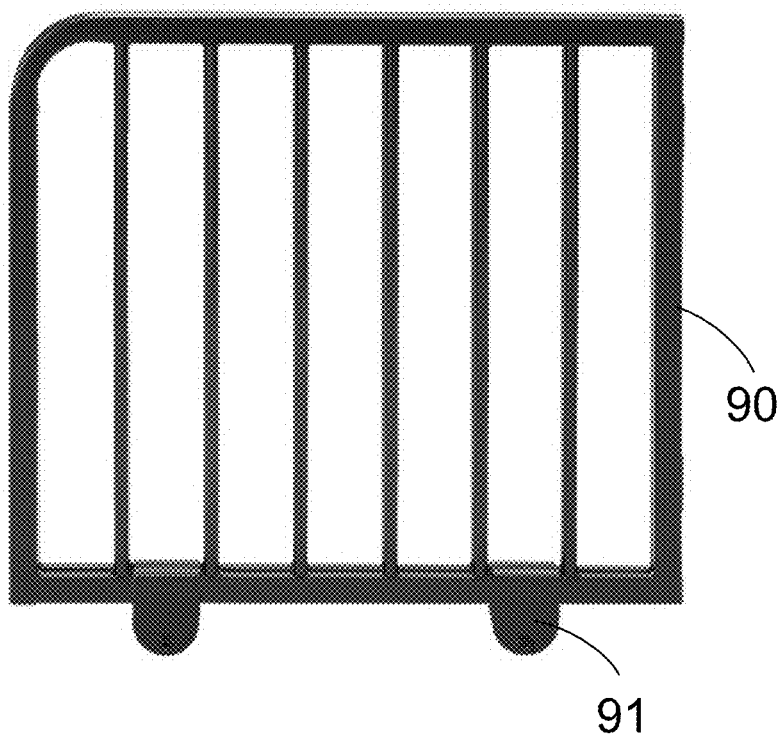
FIG. 20 is a schematic side view illustrating an exemplary back frame attachment member in accordance with some embodiments of the present invention.
Figure 21:
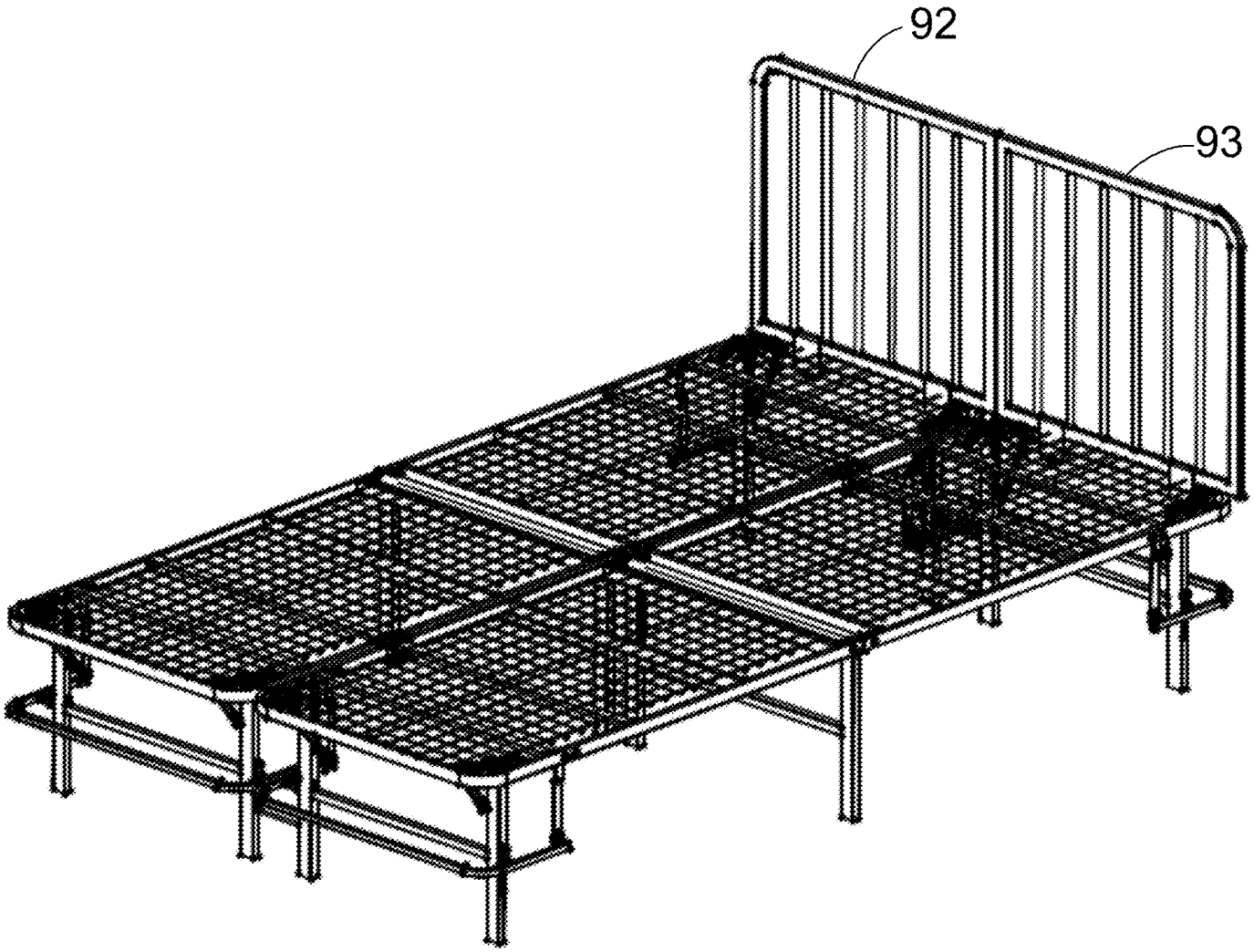
FIG. 21 is a schematic perspective view illustrating an exemplary folding bed with a back frame in accordance with some embodiments of the present invention.

A folding bed of the present invention can include some additional, alternative, or optional feature. For instance, referring to FIGS. 20 and 21, in some embodiments, folding bed 100 further includes a back frame such as back frame 90 and a plurality of back-frame connection members 91 to couple the back frame with the first and second bedsteads. In an embodiment, the frame of first bedstead 10 includes second peripheral bar 18 (e.g., the bar at the head side of the folding bed) and the frame of second bedstead 20 includes second peripheral bar 28 (see, e.g., FIG. 1). When the folding bed is in the unfolded state, the second peripheral bar of the first bedstead is aligned with the second peripheral bar of the second bedstead. The plurality of back-frame connection members 91 couples back frame 90 with second peripheral bars 18 and 28 of the first and second bedsteads.

In some embodiments, back frame 90 includes first back sub-frame 92 and second back sub-frame 93. The first back sub-frame is coupled with the second peripheral bar of the first bedstead by one or more back-frame connection members 91 and the second back sub-frame is coupled with the second peripheral bar of the second bedstead by one or more back-frame connection members 91. In an embodiment, the first and second back sub-frames are substantially the same and disposed symmetrically with respect to each other.

Assembling and disassembling a folding bed of the present invention is easy and simple. For instance, to assemble a folding bed including one or more frame connection members 50, place the first and second bedsteads side by side so that the first peripheral bar of first bedstead 10 is disposed adjacent and substantially parallel to the first peripheral bar of second bedstead 20. Then simply clamp the first peripheral bars of the first and second bedsteads together using the one or more frame connection members 50. The one or more frame connection members 50 can be spaced apart along the length direction of the first peripheral bars. To disassemble such a folding bed, just detach the one or more frame connection members 50 from the first peripheral bars.

To assemble a folding bed including one or more leg connection members, place the first and second bedsteads side by side so that a leg of first bedstead 10 is aligned with a leg of second bedstead 20. With leg connection member 30, simply clamp the legs together using the first and second engaging members of leg connection member 30. With leg connection member 60 or leg connection member 70, simply insert the first and second engaging members of leg connection member 60 or 70 into the slots formed in the legs of the first and second bedsteads. To disassemble such a folding bed, just remove the one or more leg connection members from the legs.

To assemble a folding bed including both frame and leg connection members, place the first and second bedsteads side by side so that a peripheral bar of first bedstead 10 is disposed adjacent and substantially parallel to a peripheral bar of second bedstead 20, and a leg of first bedstead 10 is aligned with a leg of second bedstead 20. Then couple the adjacent peripheral bars using the frame connection member and the adjacent legs using the leg connection member (in any order) as disclosed herein.

As disclosed herein, frame and/or leg connection members of the present invention fixedly couple the first and second bedsteads with each other. When in use, a folding bed, with the first and second bedsteads coupled by such frame and/or leg connection members, acts like one unit. For instance, lifting up any one side of the folding bed will not cause bending of the folding bed; instead the folding bed will tilt with the leg(s) on the opposite side of the folding bed as the support. As such, the risk of bending and thus damaging the folding bed is reduced and the service life of the folding bed is improved. In addition, with the first and second bedsteads coupled firmly by such frame and/or leg connection members, the folding bed is more stable and safer to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. The term "and/or" as used herein refers to and encompasses any and all possible combinations of one or more of the associated listed items. The terms "comprises" and or "comprising," when used in this specification, specify the presence of stated features, integers, steps, operations, elements, and or components, but do not preclude the presence or addition of one or more other features, integers, steps, operations, elements, components, and/or groups thereof. In addition, it will be understood that the terms "upper", "lower", "up", "down", "upwards", "downwards", "inner", "outer", "inside", "outside", "inwardly", "outwardly", "interior", "exterior", "left", "right", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bedstead could be termed a second bedstead, and, similarly, a second bedstead could be termed a first bedstead, without changing the meaning of the description, so long as all occurrences of the "first bedstead" are renamed consistently and all occurrences of the "second bedstead" are renamed consistently.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various alternatives and modifications thereof. It is intended that the scope of the invention be defined by the Claims appended hereto and their equivalents.

What is claimed is:

1. A folding bed, comprising: a first bedstead disposed on a first side and a second bedstead disposed on a second side of the folding bed, wherein each of the first bedstead and the second bedstead comprises: a frame defining an interior; a plurality of crossbars disposed in a common direction in the interior defined by the frame and coupled to the frame; and a plurality of legs coupled with the frame or one or more of the crossbars, wherein the plurality of legs comprises a first leg, wherein when the folding bed is in the unfolded state, the first leg in the plurality of legs of the first bedstead is disposed adjacent and substantially parallel to the first leg in the plurality of legs of the second bedstead; a first leg connection member coupling the first leg of the first bedstead with the first leg of the second bedstead, the first leg connection member comprising: a first engaging member removably coupling with the first leg in the plurality of legs of the first bedstead; a second engaging member removably coupling with the first leg in the plurality of legs of the second bedstead, wherein a respective engaging member in the first and second engaging members comprises: a middle portion, a first gripping portion at a first side of the middle portion, wherein the first gripping portion comprises a first finger and a second finger spaced apart along a length direction of the first leg, with a gap in-between to accommodate a link bar connected with the first leg of the corresponding bedstead; and a second gripping portion at a second side of the middle portion, wherein the second gripping portion comprises a third finger and a fourth finger spaced apart along a length direction of the first leg, wherein a first link member has an edge integrally formed with the middle portion of the respective engaging member between the third and fourth fingers, wherein the first gripping portion, the middle portion and the second gripping portion collectively form an opening to accommodate the first leg of a corresponding bedstead in the first and second bedsteads; and the first link member connecting the first and second engaging members, wherein the first engaging member, the first link member and the second engaging member are integrally formed in one unit, wherein when coupled, the first leg connection member restricts a relative movement of the first leg of the first bedstead and the first leg of the second bedstead with respect to each other.

2. The folding bed of claim 1, wherein the first and second engaging members of the first leg connection member are substantially the same and disposed substantially symmetric to each other.

3. The folding bed of claim 1, wherein an angle formed between the middle portion and the first or second gripping portion of the respective engaging member is not greater than 90°.

4. The folding bed of claim 1, wherein each finger in one or more of the first, second, third and fourth fingers comprises a free end portion bending toward an interior of the respective engaging member and then away from the interior of the respective engaging member.

5. The folding bed of claim 1, wherein:

the first leg in the plurality of legs of the first bedstead comprises a first slot to accommodate the first engaging member;

the first leg in the plurality of legs of the second bedstead comprises a second slot aligned with the first slot when the folding bed is in the unfolded state to accommodate the second engaging member.

6. The folding bed of claim 5, wherein the first leg connection member is made of a rod, wherein each of the first and second engaging members is bended with respect to the first link member.

7. The folding bed of claim 5, wherein:

the first slot and the second slot face a same common direction when the folding bed is in the unfolded state; and each of the first and second engaging members comprises a free end portion and an intermediate portion between the free end portion and the first link member, wherein the intermediate portion is bended and insertable into the first or second slot, with the free end portion disposed outside of the first or second slot to assist in disengaging the bent intermediate portion from the first or second slot.

8. The folding bed of claim 5, wherein the free end portion is bended in a plane different than a plane defined by the bent intermediate portion.

9. The folding bed of claim 5, wherein:

the first slot and the second slot face toward each other when the folding bed is in the unfolded state; and each of the first and second engaging members is formed of a substantially "n" shape, and comprises a free end portion and an intermediate portion between the free end portion and the first link member, wherein when engaged, the free end portion is inserted into the first or second slot and the intermediate portion is disposed outside of the first or second slot, such that the first engaging member is hung on a wall of the first leg of the first bedstead, and the second engaging member is hung on a wall of the first leg of the second bedstead.

10. The folding bed of claim 9, wherein an opening of the "n"-shaped first engaging member is not less than a thickness of the wall of the first leg of the first bedstead, and an opening of the "n"-shaped second engaging member is not less than a thickness of the wall of the first leg of the second bedstead.

11. The folding bed of claim 9, wherein a height of the "n"-shaped first engaging member is not less than a height of the first slot in the first leg of the first bedstead, and a height of the "n"-shaped second engaging member is not less than a height of the second slot in the first leg of the second bedstead.

12. The folding bed of claim 9, wherein a distance between an opening of the "n"-shaped first engaging member and an opening of the "n"-shaped second engaging member is substantially the same as a distance between the first leg of the first bedstead and the first leg of the second bedstead.

13. The folding bed of claim 1, wherein the frame of each of the first and second bedsteads comprises a first peripheral bar, wherein when the folding bed is in the unfolded state, the first peripheral bar of the frame of the first bedstead is disposed adjacent and substantially parallel to the first peripheral bar of the frame of the second bedstead, the folding bed further comprising:

one or more frame connection members disposed between the first bedstead and the second bedstead when the folding bed is in the unfolded state, and coupling the first peripheral bar of the frame of the first bedstead with the first peripheral bar of the frame of the second bedstead, wherein corresponding to each respective bedstead in the first and second bedsteads, each frame connection member comprises:

a horizontal member abutting a top surface or a bottom surface of the first peripheral bar of the frame of the respective bedstead;

a first vertical end portion at a first edge of the horizontal member, and disposed at an internal side of the respective bedstead; and a second vertical end portion at an opposite second edge of the horizontal member, and disposed at the internal side of the respective bedstead.

14. The folding bed of claim 13, wherein each respective vertical end portion in the first and second vertical end portions comprises a bent protrusion configured to extend towards an interior of the frame connection member.

15. The folding bed of claim 13, wherein the first and second vertical end portions are spaced apart with a gap in-between to accommodate an end of a crossbar in the plurality of crossbars of the respective bedstead.

16. The folding bed of claim 13, wherein an angle formed between the horizontal member and each respective vertical end portion is not greater than 90°.

17. A folding bed, comprising:

a first bedstead disposed on a first side and a second bedstead disposed on a second side of the folding bed, wherein each of the first bedstead and the second bedstead comprises:

a frame defining an interior;

a plurality of crossbars disposed in a common direction in the interior defined by the frame and coupled to the frame; and a plurality of legs coupled with the frame or one or more of the crossbars, wherein the plurality of legs comprises a first leg, wherein when the folding bed is in the unfolded state, the first leg in the plurality of legs of the first bedstead is disposed adjacent and substantially parallel to the first leg in the plurality of legs of the second bedstead;

a first leg connection member coupling the first leg of the first bedstead with the first leg of the second bedstead, the first leg connection member comprising:

a first engaging member removably coupling with the first leg in the plurality of legs of the first bedstead;

a second engaging member removably coupling with the first leg in the plurality of legs of the second bedstead; and a first link member connecting the first and second engaging members, wherein the first engaging member, the first link member and the second engaging member are integrally formed in one unit, wherein when coupled, the first leg connection member restricts a relative movement of the first leg of the first bedstead and the first leg of the second bedstead with respect to each other;

wherein the frame of each of the first and second bedsteads comprises a first peripheral bar, wherein when the folding bed is in the unfolded state, the first peripheral bar of the frame of the first bedstead is disposed adjacent and substantially parallel to the first peripheral bar of the frame of the second bedstead, the folding bed further comprising:

one or more frame connection members disposed between the first bedstead and the second bedstead when the folding bed is in the unfolded state, and coupling the first peripheral bar of the frame of the first bedstead with the first peripheral bar of the frame of the second bedstead, wherein corresponding to each respective bedstead in the first and second bedsteads, each frame connection member comprises:

a horizontal member abutting a top surface or a bottom surface of the first peripheral bar of the frame of the respective bedstead;

a first vertical end portion at a first edge of the horizontal member, and disposed at an internal side of the respective bedstead; and a second vertical end portion at an opposite second edge of the horizontal member, and disposed at the internal side of the respective bedstead;

wherein the horizontal member is recessed downwardly towards the bent protrusion to form a groove, and the first peripheral bar of the frame of the respective bedstead is disposed between a first side of the groove and the respective vertical end portion.

18. The folding bed of claim 13, wherein an angle formed between the horizontal member and the first side of the groove is not greater than 90°.

19. The folding bed of claim 1, further comprising:

a back frame; and a plurality of back-frame connection members coupling the back frame with the first and second bedsteads.

20. The folding bed of claim 19, wherein:

the frame of each of the first and second bedsteads comprises a second peripheral bar, wherein when the folding bed is in the unfolded state, the second peripheral bar of the frame of the first bedstead is aligned with the second peripheral bar of the frame of the second bedstead; and the back frame comprises:

a first back sub-frame coupled with the second peripheral bar of the frame of the first bedstead by one or more back-frame connection members in the plurality of back-frame connection members; and a second back sub-frame coupled with the second peripheral bar of the frame of the second bedstead by one or more back-frame connection members in the plurality of back-frame connection members.

21. A leg connection member of a folding bed, wherein the folding bed comprises a first bedstead disposed on a first side and a second bedstead disposed on a second side of the folding bed, wherein each of the first bedstead and the second bedstead comprises a first leg, wherein when the folding bed is in an unfolded state, the first leg of the first bedstead is disposed adjacent and substantially parallel to the first leg of the second bedstead, the leg connection member comprising: a first engaging member removably coupling with the first leg of the first bedstead; a second engaging member removably coupling with the first leg of the second bedstead, wherein a respective engaging member in the first and second engaging members comprises: a middle portion, a first gripping portion at a first side of the middle portion, wherein the first gripping portion comprises a first finger and a second finger spaced apart along a length direction of the first leg, with a gap in-between to accommodate a link bar connected with the first leg of the corresponding bedstead, and a second gripping portion at a second side of the middle portion, wherein the second gripping portion comprises a third finger and a fourth finger spaced apart along a length direction of the first leg, wherein a first link member has an edge integrally formed with the middle portion of the respective engaging member between the third and fourth fingers, and wherein the first gripping portion, the middle portion and the second gripping portion collectively form an opening to accommodate the first leg of a corresponding bedstead in the first and second bedsteads; and the first link member connecting the first and second engaging members, wherein the first engaging member, the first link member and the second engaging member are integrally formed in one unit, and wherein when coupled, the first leg connection member restricts a relative movement of the first leg of the first bedstead and the first leg of the second bedstead with respect to each other.

* * * * *